US007011017B2

(12) United States Patent
Satou et al.

(10) Patent No.: US 7,011,017 B2
(45) Date of Patent: Mar. 14, 2006

(54) COMPACTOR

(75) Inventors: Daiki Satou, Atsugi (JP); Masataka Ishihara, Utsunomiya (JP); Yoshihiro Seio, Ikoma-gun (JP); Mitsuma Matsuda, Kashiwara (JP); Tsunetsugu Hasegawa, Machida (JP); Mitsuru Yamamoto, Itano-gun (JP)

(73) Assignees: Koyo Seiko Co., Ltd., Osaka (JP); San-Ai Engineering Co., Ltd., Kanagawa (JP)

( * ) Notice: Subject to any disclaimer, the term of this patent is extended or adjusted under 35 U.S.C. 154(b) by 0 days.

(21) Appl. No.: 10/415,233

(22) PCT Filed: Mar. 22, 2002

(86) PCT No.: PCT/JP02/02738

§ 371 (c)(1),
(2), (4) Date: Apr. 25, 2003

(87) PCT Pub. No.: WO02/074526

PCT Pub. Date: Sep. 26, 2002

(65) Prior Publication Data

US 2004/0020378 A1 Feb. 5, 2004

(30) Foreign Application Priority Data

Mar. 21, 2001 (JP) ..... 2001-079785

(51) Int. Cl.
*B30B 9/28* (2006.01)

(52) U.S. Cl. ..... 100/179; 100/247; 100/906

(58) Field of Classification Search ..... 100/95, 100/98 R, 110, 126, 127, 179, 247, 248, 903, 100/906, 909, 240, 245
See application file for complete search history.

(56) References Cited

U.S. PATENT DOCUMENTS 5,307,739 A 5/1994 Gourdol

FOREIGN PATENT DOCUMENTS

| | | |
|---|---|---|
| JP | 05278077 A | * 10/1993 |
| JP | 5-305496 | 11/1993 |
| JP | 09-239593 | 9/1997 |
| JP | 09-286667 | 8/1998 |
| JP | 2001-198698 | 7/2001 |

OTHER PUBLICATIONS

International Search Report, dated Jun. 25, 2002, issued by the Japanese Patent Office, for International Patent No. PCT/JP02/02738 (2 pages).

* cited by examiner

*Primary Examiner*—Derris H. Banks
*Assistant Examiner*—Jimmy T. Nguyen
(74) *Attorney, Agent, or Firm*—Smith, Gambrell & Russell, LLP

(57) ABSTRACT

A compactor is provided wherein cuttings delivered to a compaction chamber 33 by a screw conveyor 22 are compacted into a solid product W by operating a hydraulic cylinder 28, and subsequently a gate member 51 disposed at one end of the compaction chamber 33 is opened so as to discharge the solid product W via the one end of the compaction chamber 33. The compaction chamber 33 includes a first cylindrical body 31 and a second cylindrical body 40. The second cylindrical body 40 is removably mounted to one end of the first cylindrical body 31 for facilitating the replacement of the second cylindrical body 40 when the second cylindrical body 40 is worn.

8 Claims, 12 Drawing Sheets

COMPACTOR

TECHNICAL FIELD

The present invention relates to a compactor for compacting metal cuttings into a solid product, the cuttings produced by a variety of cutting processes or grinding processes.

BACKGROUND ART

When a metal is machined by operating a cutting machine such as a lathe, drilling machine or the like, or a grinding machine such as a surface grinding machine, external cylindrical grinding machine or the like, there are produced cuttings in the form of coil or powder. The cuttings are industrial waste and hence, a demand exists for processing the cuttings into a shape as compact as possible for easy transportation. In this connection, compactors have been developed and marketed which produce high-density solid products by compacting the cuttings.

The compactor is arranged such that the cuttings fed from a hopper are delivered by a screw conveyor to a compaction chamber of a cylindrical body having a circular or rectangular section; and that the cuttings in the compaction chamber are compacted into a solid product by means of a hydraulic cylinder and then a movable gate member disposed at one end of the compaction chamber is opened so as to discharge the solid product of the compacted cuttings out of the compaction chamber. In some cases, a pressing force applied to the cuttings by the hydraulic cylinder may exceed 40 tons so that the cylindrical body constituting the compaction chamber may be subject to a pressure in excess of 1000 kgf/cm$^2$. This involves a problem that the gate member becomes hard to open because of a pressing force from the solid product thus formed and a frictional force between the solid product and an inside wall of the compaction chamber. As a solution to the above problem, the inventors have developed a compactor wherein the cylindrical body includes an outside cylinder and an inside cylinder axially movably accommodated in the outside cylinder, and then have acquired the right to a patent (U.S. Pat. No. 2,949,664).

The above compactor is often used for compacting abrasive dusts and small-particle metallic residues (sludge) produced during a metal polishing process. The sludge contains abrasive grains which are dusts from an abrasive stone. The metal polishing process employs a variety of polishing materials according to the types of metals to be polished. Main polishing materials include alumina oxide abrasive grains, silicon carbide abrasive grains, CBN (cubic boron nitride) abrasive grains, diamond abrasive grains and the like. It is known that the alumina oxide abrasive grains are used in greater quantities.

In the aforementioned abrasive grains, even the alumina oxide abrasive grains of the lowest Knoop Hardness (HK) have a hardness on the order of 1950 to 2050, which is higher than a Knoop Hardness (1700–1940) of a sintered hard alloy. It was found that because of the pressing force for forming the solid product as well as the frictional force between the solid product and the inside wall of the compaction chamber, an inside wall portion near an end of the compaction chamber is worn seriously during the compaction of the sludge containing the abrasive grains.

The wear on the inside wall of the compaction chamber results in a solid product having an increased outside diameter at an axially intermediate portion thereof. This leads to a problem that the solid product cannot be discharged although the solid product is pushed by the hydraulic cylinder after the gate member is opened. When such a problem is encountered by the conventional compactor, a measure to be taken by the current practice is to replace the worn cylindrical body.

Unfortunately, in the arrangement wherein the compaction chamber consists of a single cylindrical body, it is difficult, by definition, to replace the cylindrical body itself. Even in the arrangement wherein the cylindrical body consists of the outside cylinder and the inside cylinder accommodated therein, the replacement requires considerable cost and time because the inside cylinder has a length to cover a distance from a rearward position of a cylinder rod of the hydraulic cylinder to the gate member. For instance, the existing state is such that a number of service workers take a number of hours to disassemble the gate member and hydraulic cylinder of the compactor and to replace the inside cylinder. There is another problem that experience is required to adjust the position of the inside cylinder relative to the cylinder rod because the inside cylinder extends to the rearward position of the cylinder rod.

It is an object of the invention to provide a compactor permitting the worn cylindrical body constituting the compaction chamber to be replaced by a low-cost and relatively simple operation.

DISCLOSURE OF THE INVENTION

A compactor according to the invention comprises:

a first cylindrical body including an expansion formed at an inner periphery of one end portion thereof and having a greater inner circumferential dimension than that of the other end portion thereof, and accommodating therein a material to be compacted; a second cylindrical body replaceably mounted in the expansion of the first cylindrical body to form a compaction chamber jointly with the first cylindrical body, and having an inner peripheral surface flush with that of the first cylindrical body; a pressing mechanism for pressing the material to be compacted toward the one end of the compaction chamber, the material accommodated in the first cylindrical body; and a gate mechanism for opening/closing the one end of the compaction chamber.

According to the invention, the second cylindrical body is mounted to the one end of the first cylindrical body in a replaceable manner and hence, the second cylindrical body may be replaced at the time when the wear on the inner periphery of the second cylindrical body exceeds a predetermined quantity as a result of the pressing force from the solid product and the frictional force between an outer periphery of the solid product and an inner periphery of the second cylindrical body. Thus, it is possible to continue to use the compaction chamber without interference. The second cylindrical body only need be formed in the vicinity of one end of the compaction chamber to serve the purpose and therefore, the material cost therefor can be notably decreased. Since the second cylindrical body is provided only at place near the one end of the compaction chamber, labor and time required for the replacement can be substantially decreased.

In one preferred mode, an axial length of the second cylindrical body is substantially not less than 3/5 times the axial length of a compact obtained by compacting the material to be compacted. This is based on the findings of the inventors that the wear on the inner periphery of the second cylindrical body, caused by the compact, peaks at a point away from a distal end of the second cylindrical body for about 3/10 of the axial length of the formed compact and that the inner periphery of the second cylindrical body is less susceptible to wear at a point away from the distal end thereof for about 3/5 times the axial length of the compact.

In another preferred mode, at least an inner periphery of the second cylindrical body has a higher hardness than that of the inner periphery of the first cylindrical body. This is effective to slow down the wearing speed of the inner periphery of the second cylindrical body so that the service life thereof can be extended. In addition, the second cylindrical body is provided only at place near the one end of the first cylindrical body so that the second cylindrical body is formed using a small amount of material. Accordingly, there is no fear of an extreme cost increase despite the use of an expensive material having a high hardness.

It is preferred that at least the inner periphery of the second cylindrical body is formed of a sintered. This provides a more effective decrease of the wearing speed of the inner periphery of the second cylindrical body, resulting in further extension of the second cylindrical body.

In another preferred mode, the second cylindrical body comprises an outside cylinder hardened by quenching, and an inside cylinder formed of a sintered hard alloy and fitted in an inner periphery of the outside cylinder. In this case, as well, the service life of the second cylindrical body can be extended even further. Since the use of the sintered hard alloy can be decreased as compared with the case where the whole body of the second cylindrical body is formed of the sintered hard alloy, there is no fear of an extreme cost increase for the second cylindrical body. It is preferred in this mode that a fitting surface between the inside cylinder and the outside cylinder is a tapered surface having the radial dimension thereof progressively decreased toward the one end of the second cylindrical body. This permits, for example, the inside cylinder to be readily and positively shrink fitted in the outside cylinder for unification free from fracture.

In yet another preferred mode, the second cylindrical body is formed with a discharge passage at an end face and outer peripheral surface thereof, the discharge passage serving to guide liquid, discharged from the material to be compacted, out of the compaction chamber. Thus can be obtained a solid product containing less residual liquid.

In still another preferred mode, the second cylindrical body comprises a plurality of cylinder members arranged in end-to-end relation. In this case, the running costs can be decreased because only a cylinder member suffering a great quantity of wear may be replaced.

In still another preferred mode, the gate mechanism defines a gate space of a sufficient size for permitting the second cylindrical body to be mounted to or removed from the first cylindrical body in a state where the one end of the compaction chamber is opened. In this case, in the state where the one end of the compaction chamber is opened by the gate mechanism, the second cylindrical body can be pulled out from the first cylindrical body via the gate space of the gate mechanism or a new second cylindrical body can be mounted to the first cylindrical body via the gate space of the gate mechanism. Therefore, the replacement of the second cylindrical body can be done without removing the gate mechanism, leading to an easy and fast replacement operation.

BEST MODE FOR CARRYING OUT THE INVENTION

Figure 1:
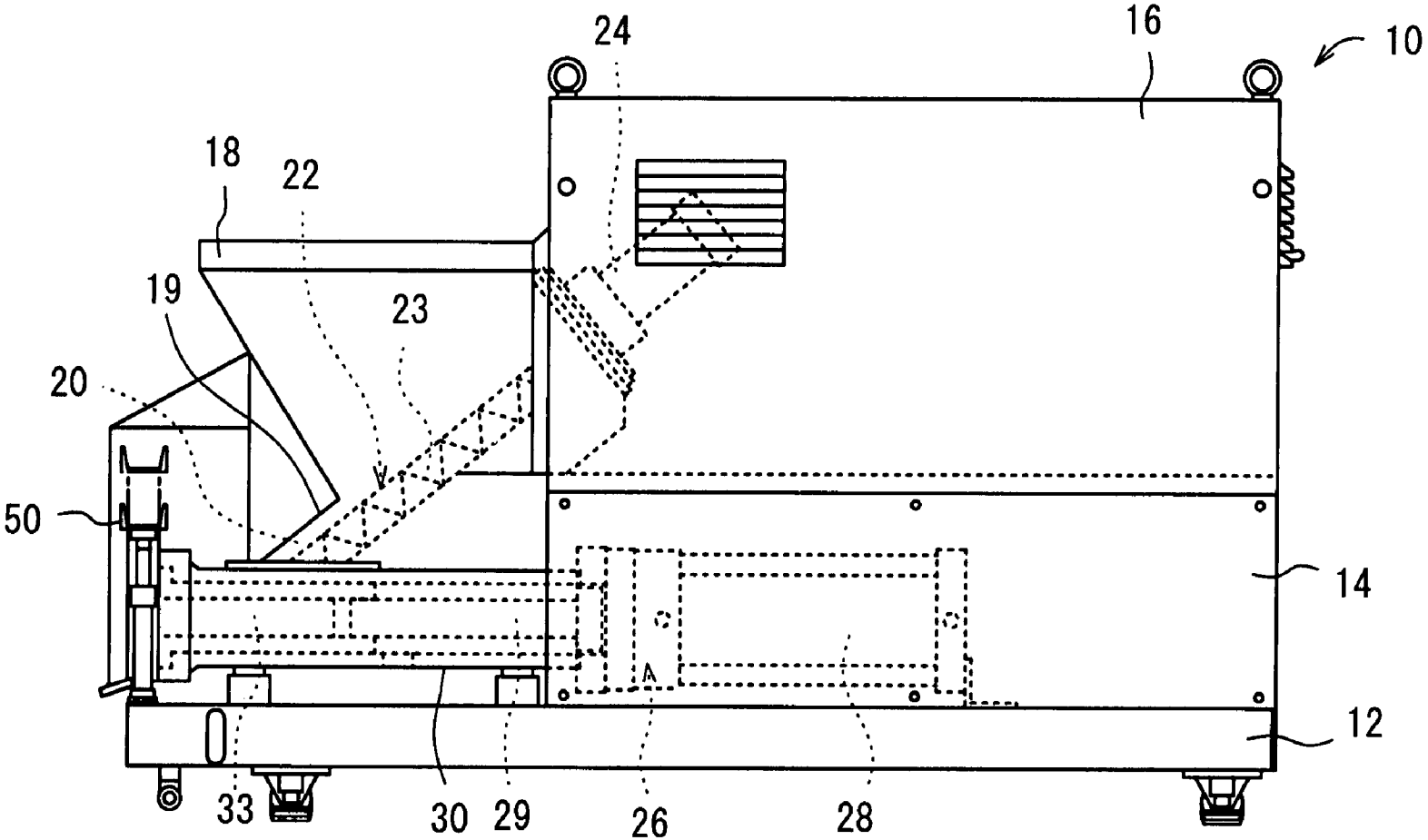
FIG. 1 is a schematic front view showing a compactor according to one embodiment of the invention.

An embodiment of the invention will hereinbelow be described with reference to the accompanying drawings. FIG. 1 is a schematic front view showing a compactor according to one embodiment of the invention. A compactor 10 according to the embodiment of the invention includes a base 12 fixed to an installation area of a plant or the like; a lower section 14 disposed on the base 12 and accommodating a variety of operating portions; and an upper section 16 accommodating a variety of control members.

Within a casing of the upper section 16, there are accommodated a hydraulic flow control unit (not shown) for operating a hydraulic cylinder 28, which will be described hereinlater; a motor 24 for effecting the transportation of cuttings and the like fed in a hopper 18, which will be described hereinlater; and the like.

According to the description hereinafter, a right-hand side as seen in FIG. 1 where the upper section 16 is disposed will be referred to as "upstream side" whereas a left-hand side as seen in the figure will be referred to as "downstream side". The compactor 10 is provided with the hopper 18 on the downstream side of the base 12 and at place higher than the lower section 14. The hopper 18 opens at top such that cuttings as a material to be compacted are fed therein, and has its horizontal dimension progressively decreased toward bottom. At a lower part of the hopper 18, an extension 19 is extended diagonally at a predetermined angle. A feed port 20 for cuttings is formed within the extension 19. Disposed within the hopper 18 and the feed port 20 thereof is a screw conveyor 22 which is inclined at substantially the same angle as the extension 19. An upper end of the screw conveyor 22 is fixed to the motor 24. The cuttings fed into the hopper 18 are allowed to drop to be delivered to the feed port 20 by means of vanes 23 spirally provided on the screw conveyor 22. Since the feed port 20 is inclined at the predetermined angle as described above, the amount of cuttings delivered via the feed port 20 by means of the vanes 23 of the screw conveyor 22 is substantially maintained at a constant level.

Figure 2:
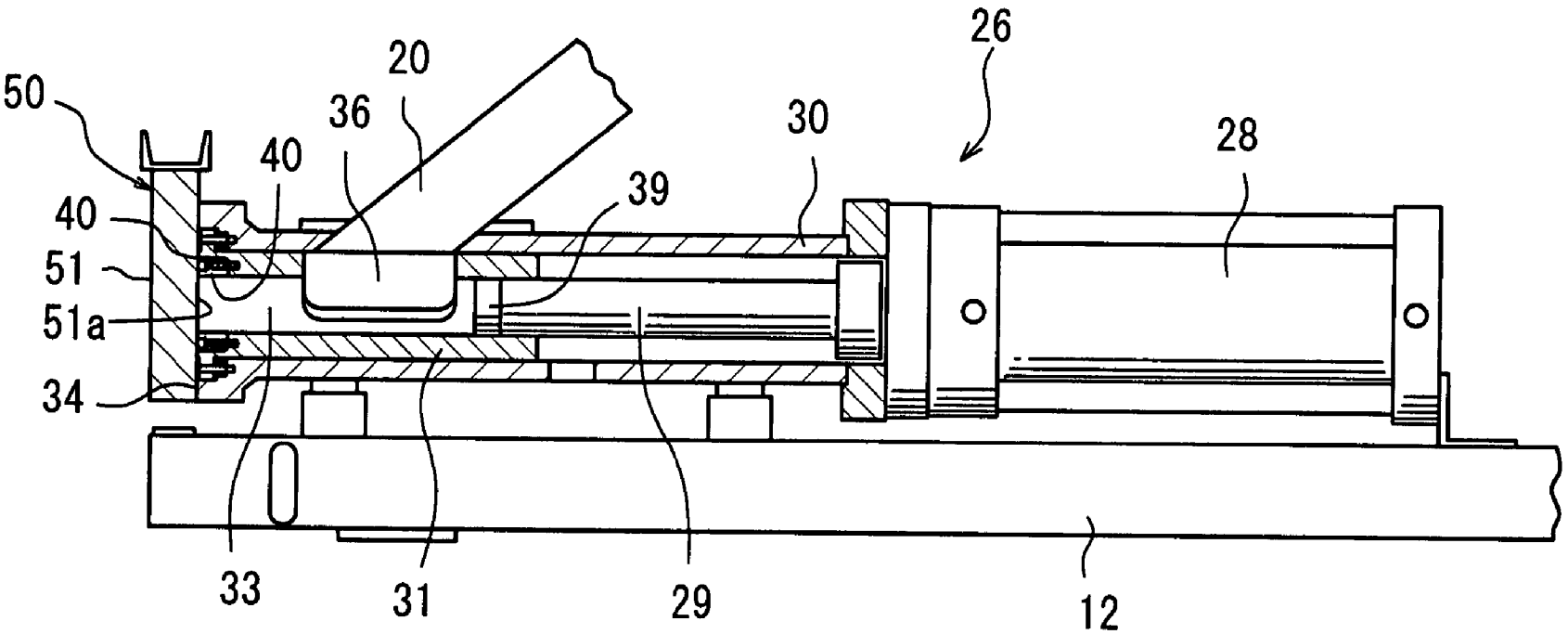
FIG. 2 is a detailed view showing a lower section of the compactor.

FIG. 2 shows the lower section 14 of the compactor 10 in more details. As seen in the figure, a molding press 26 is fixed to place on the base 12. The molding press 26 includes the hydraulic cylinder 28 serving as a pressing mechanism disposed on the upstream side; a cylindrical casing 30 extended from a downstream end of the hydraulic cylinder 28 along a downstream direction; and a compaction chamber 33 disposed at a downstream end of the casing 30. A cylinder rod 29 of the hydraulic cylinder 28 is introduced into the compaction chamber 33 and has a disc-like tip 39 attached to a distal end thereof, the tip 39 formed in conformity with an inside diameter of the compaction chamber 33. The tip 39 is formed of a bearing steel, such as SUJ-2 or the like, which is hardened by quenching. It is noted that the casing 30 is equivalent to the outside cylinder of the prior art.

The compaction chamber 33 includes a first cylindrical body 31, and a second cylindrical body 40 disposed in an inner periphery of a downstream end (one end portion) of the first cylindrical body. The first cylindrical body 31 is extended from an intermediate portion of the casing 30 to a downstream direction and has its outer periphery slidably fitted in an inner periphery of the casing 30. The first cylindrical body 31 is formed of a bearing steel such as SUJ-2 or a dies steel such as SKD-11, which is hardened to a hardness of about HRC 58 to 60 by heat treatment. The first cylindrical body 31 has an inside diameter equal to an outside diameter of the tip 39 so that the tip 39 has its outer periphery in contact with the inner periphery of the first cylindrical body 31 when axially moved by means of the hydraulic cylinder 28. Downstream end faces 34 of the casing 30 and the first cylindrical body 31 are substantially flush with each other. A vertically movable gate member 51 is in intimate contact with these end faces 34 thereby closing a downstream open end of the compaction chamber 33. The first cylindrical body 31 is equivalent to the inside cylinder of the prior art.

An aperture 36 is formed at an upper part of the casing 30 and of the first cylindrical body 31. The aperture 36 is formed in correspondence to the extension 19 of the hopper 18 and therefore, the cuttings fed in the hopper 18 are delivered to the feed port 20 by the vanes 23 of the screw conveyor 22 so as to be finally allowed to drop into the first cylindrical body 31 via the aperture 36.

As the cylinder rod 29 of the hydraulic cylinder 28 is axially moved from the upstream side toward the downstream side by the operation of the hydraulic flow control unit, the volume of the compaction chamber 33 or the axial length thereof is decreased in accordance with the movement of the cylinder rod 29, the volume or axial length of the compaction chamber 33 defined by an end face of the tip 39 at the distal end of the cylinder rod 29, a back side 51*a* of the gate member 51 and the inner periphery of the first cylindrical body 31. Thus, the cuttings fed into the compaction chamber 33 via the aperture 36 are compressed in the compaction chamber 33.

Figure 3:
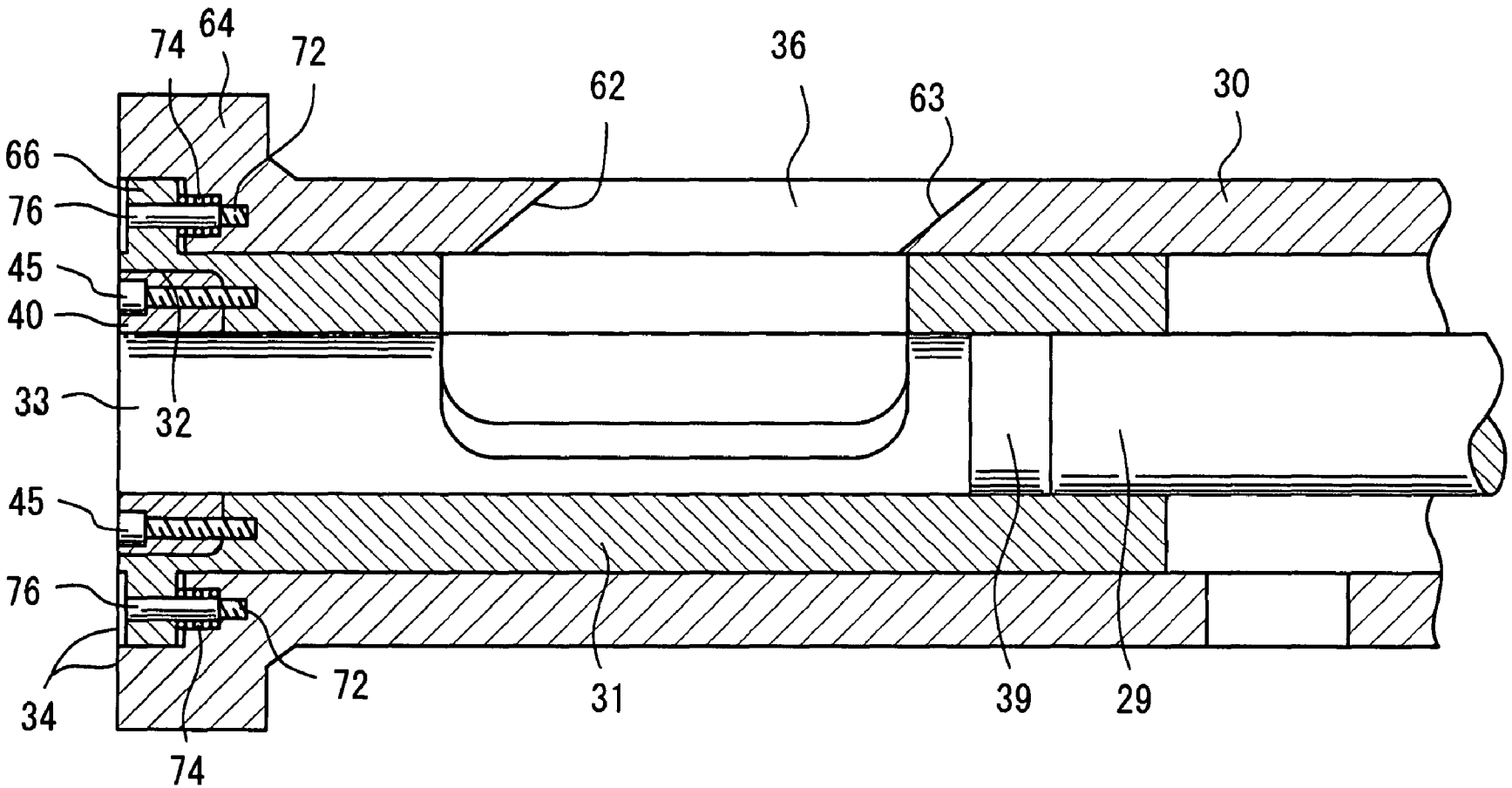
FIG. 3 is an enlarged sectional view showing a downstream side of a molding press.

FIG. 3 is an enlarged sectional view showing a downstream side of the molding press 26. As seen in the figure, the first cylindrical body 31 is formed with an expansion 32 at the downstream end thereof, the expansion having a greater inner circumferential dimension than an upstream portion of the first cylindrical body. Thus, the second cylindrical body 40 is replaceably fitted in the expansion 32. The second cylindrical body 40 is formed of a harder material than that of the first cylindrical body 31, the material including a dies steel such as SKD-11 which is hardened to a hardness of about HRC 62 to 63 by heat treatment, a sintered hard alloy and the like. The second cylindrical body 40 is formed with threaded holes, through which bolts 45 are threaded in female threads of the first cylindrical body 31. The bolts 45 assure that the second cylindrical body 40 is positively secured to the first cylindrical body 31. The second cylindrical body 40 has the same inside diameter as that of the first cylindrical body 31 so that the compaction chamber 33 has a planar inner periphery.

Slopes 62, 63 are formed at the upper part of the casing 30 in a manner to be continuous to the feed port 20. The casing 30 is also formed with a flange 64 at the downstream end thereof and has its inside diameter increased at place near the flange 64.

Figure 4:
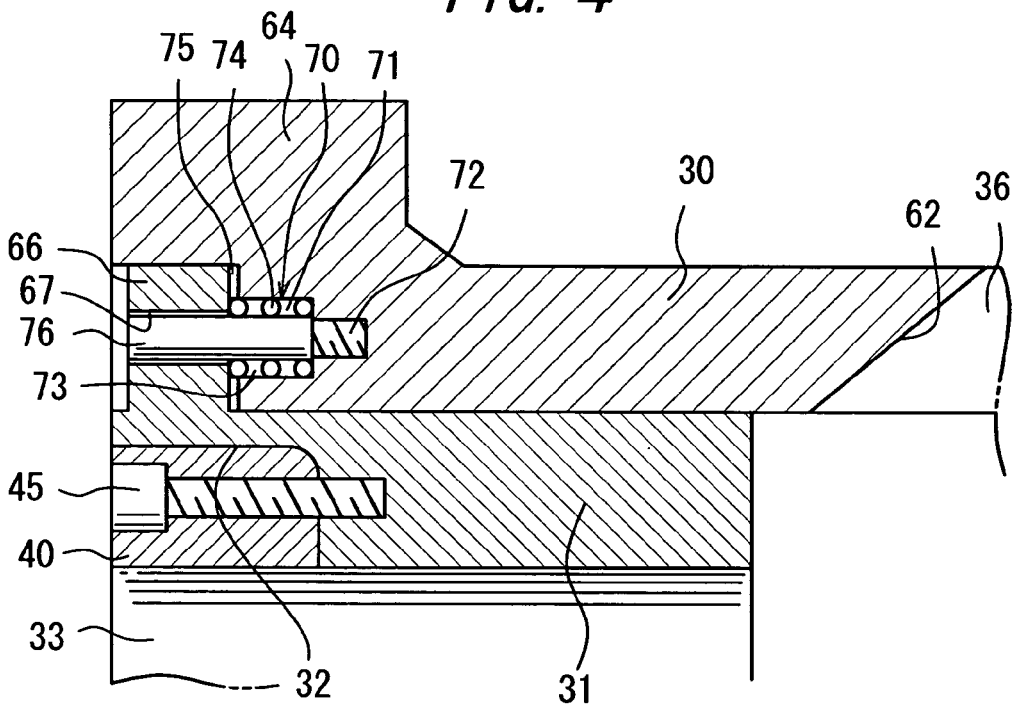
FIG. 4 is an enlarged sectional view showing a portion near a downstream end of a first cylindrical body.

The first cylindrical body 31 is also formed with a flange 66 at the downstream end thereof, the flange 66 substantially conforming with the inside diameter expansion of the casing 30. As shown in FIG. 4, the flange 66 of the first cylindrical body 31 is formed with a through-hole 67, whereas the casing 30 is formed with a closed-end hole 70 in correspondence to the through-hole 67. The closed-end hole 70 includes a greater diameter portion 71 formed on an opposite side from the flange 66 of the first cylindrical body 31, and a smaller diameter portion 72 formed continuously with the greater diameter portion 71 and including a female thread. A pin 76 formed with a male thread at its distal end portion is inserted in the through-hole 67 and the closed-end hole 70. The male thread of the pin 76 is threaded in the smaller diameter portion 72. The greater diameter portion 71 and the pin 76 define an annular space 73 therebetween, which receives therein a compression helical spring 74 resiliently contracted. Therefore, the first cylindrical body 31 is urged toward the downstream side by a resilient force of the helical spring 74. In this state, a small gap 75 is defined between an upstream end of the flange 66 of the first cylindrical body 31 and an opposite end face of the inside diameter expansion of the casing 30.

Figure 5:
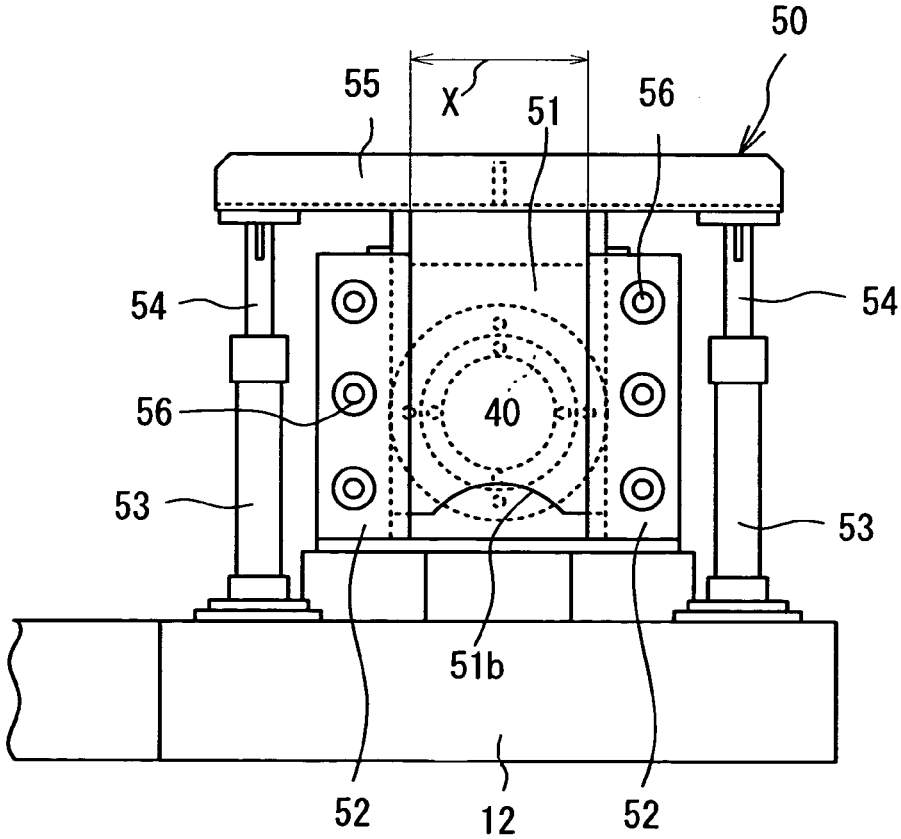
FIG. 5 is a side view showing a gate mechanism.

FIG. 5 is a side view of a gate mechanism 50. As seen in the figure, the gate mechanism 50 includes the aforesaid gate member 51; guide members 52 disposed on opposite sides of the gate member 51 for guiding the vertical movement of the gate member 51; a pair of hydraulic cylinders 53 disposed on opposite sides of the guide members 52; and a connection member 55 for interconnecting upper ends of cylinder rods 54 of the hydraulic cylinders 53. The gate member 51 has its upper end fixed to a bottom of the connection member 55 and is formed with an arcuate notch 51*b* at its lower portion. An upper portion of the notch 51*b* is located somewhat higher relative to the outer periphery of the second cylindrical body 40. The guide members 52 are secured to the flange 64 of the casing 30 by means of bolts 56. The gate mechanism 50 is arranged such that the hydraulic cylinders 53 are operated to raise the cylinder rods 54 along with the connection member 55, whereby the gate member 51 fixed to the connection member is pulled up as guided by the guide members 52. Thus is opened an open end of the compaction chamber 33 defined in the first cylindrical body 31.

A gate width X defined between the pair of guide members 52 is designed to be greater than an outside diameter of the second cylindrical body 40. The gate member 51 is pulled up to such a position as to bring its lower end out of overlap with one end face of the second cylindrical body 40. Therefore, the gate mechanism 50 with the gate member 51 raised to place can provide a gate space of a sufficient size to permit the second cylindrical body 40 to be fixed to or removed from the first cylindrical body 31, the gate space defined by the pair of guide members 52 and the gate member 51.

The operations of the compactor 10 thus arranged are described as below. First, the hydraulic cylinder 28 of the molding press 26 is activated to move the cylinder rod 29 thereof to a predetermined rearward position. At this time, the gate member 51 is positioned at a lower position so as to close the compaction chamber 33.

Figure 6:
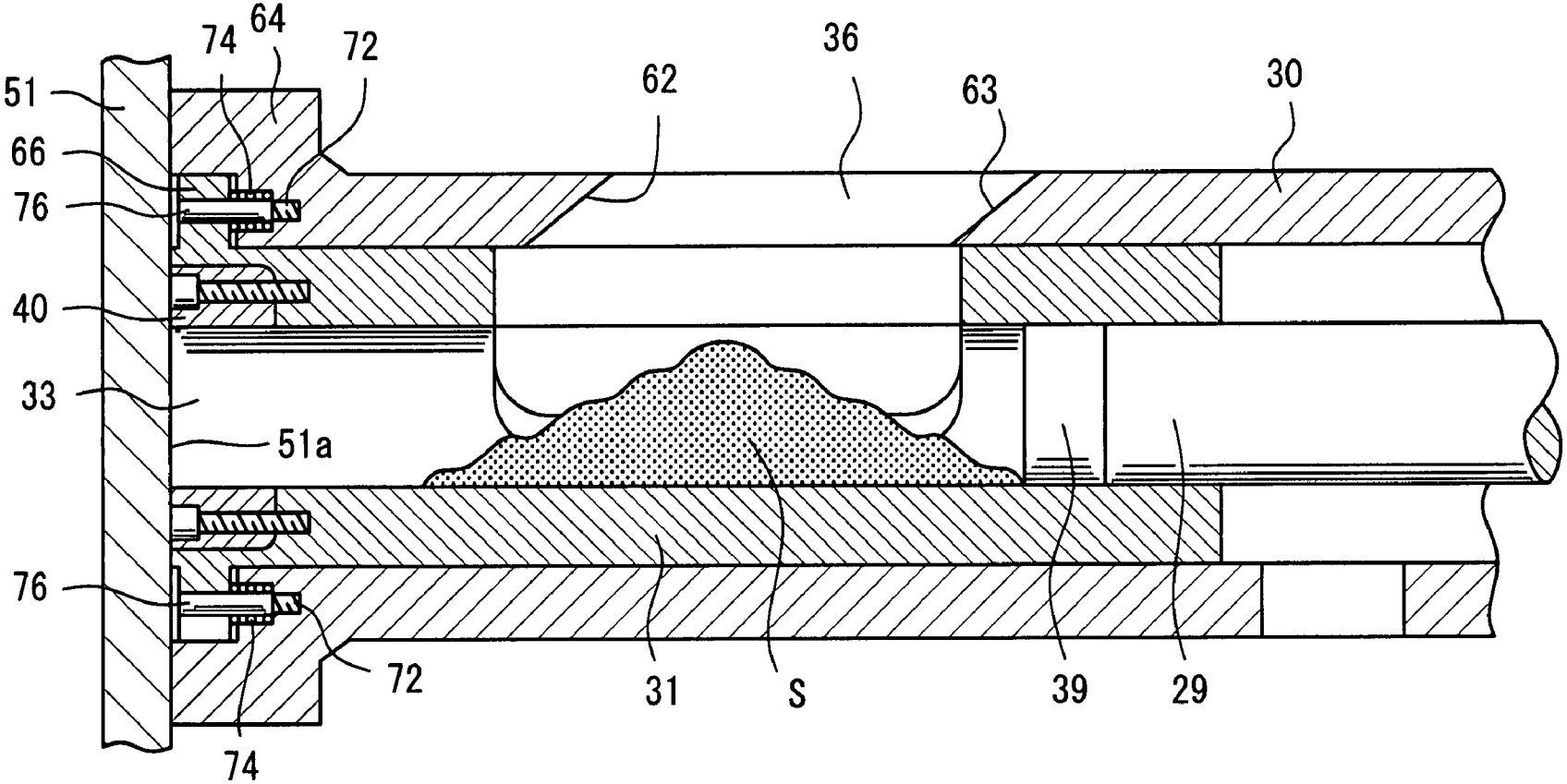
FIG. 6 is a sectional view showing an essential part wherein cuttings are loaded in a compaction chamber.
Figure 7:
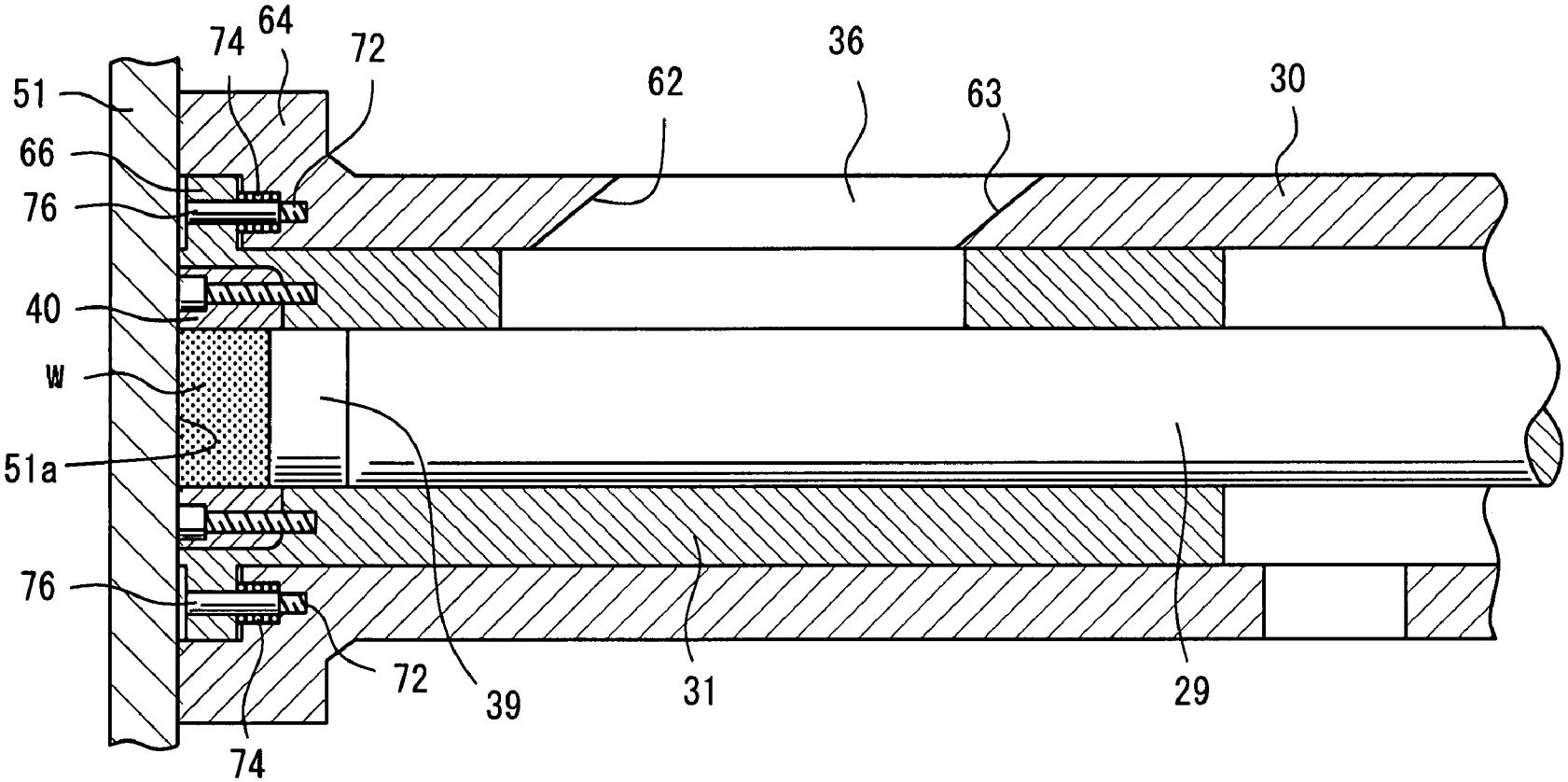
FIG. 7 is a sectional view showing the essential part wherein the cuttings loaded in the compaction chamber are compressed.
Figure 8:
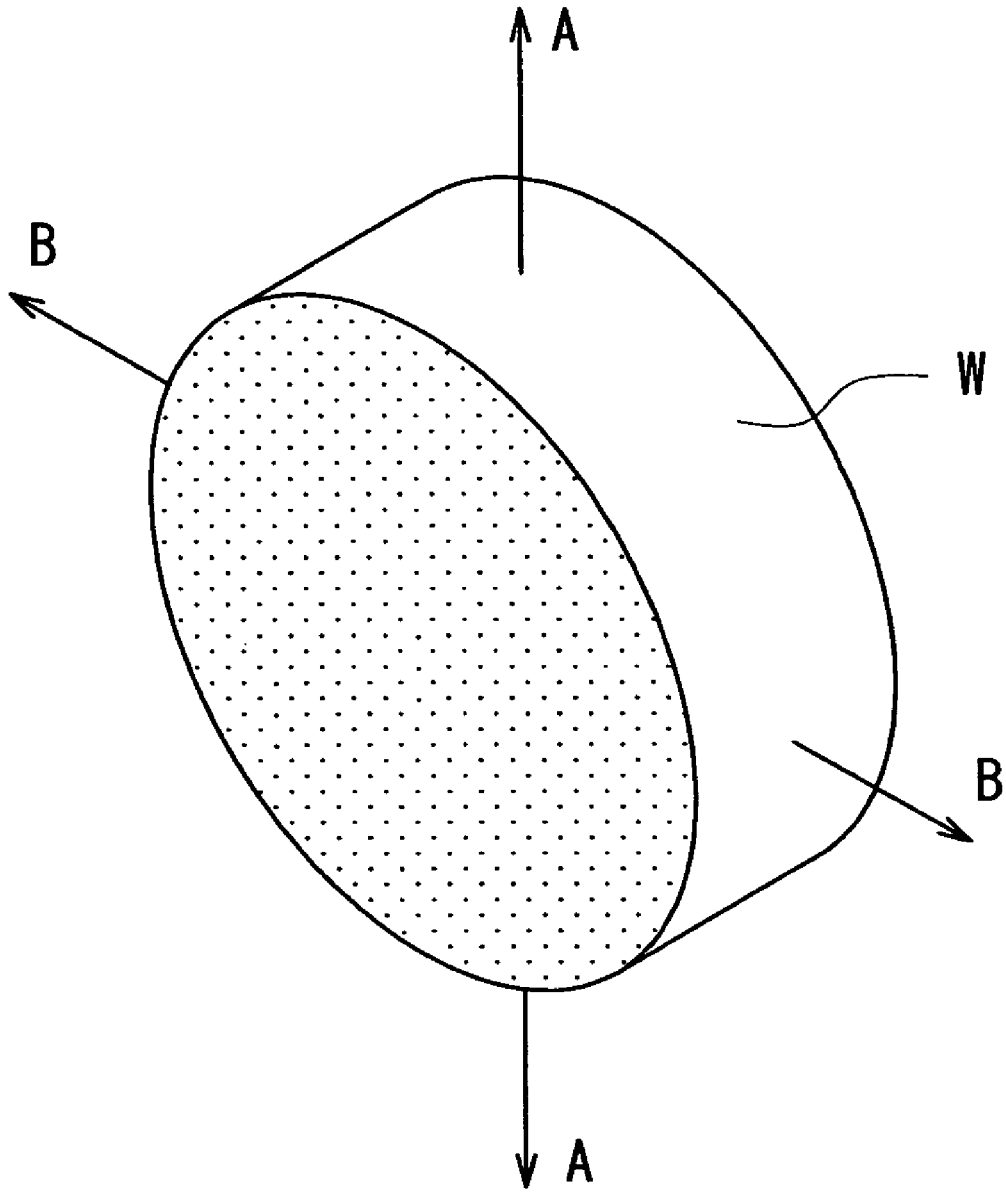
FIG. 8 is a perspective view showing a solid product formed according to the embodiment of the invention.

FIG. 6 is a sectional view showing an essential part of the compaction chamber when the cylinder rod 29 is at the rearward position. The motor 24 is activated to rotate the screw conveyor 22 in a predetermined direction, while the cuttings are fed into the hopper 18 via its opening. The cuttings thus supplied are transported downward by means of the vanes 23 of the screw conveyor 22, fed into the compaction chamber 33 via the aperture 36 (represented by a symbol S in FIG. 6). When a predetermined amount of cuttings is loaded in the compaction chamber 33, the hydraulic cylinder 28 is activated to move the cylinder rod 29 axially from the upstream side to the downstream side. Accordingly, the cuttings are progressively gathered to the downstream side so that a solid product W (see FIG. 8) of cylindrically compacted cuttings is finally formed in the compaction chamber 33 enclosed by the end face of the tip 39, the inner periphery of the first cylindrical body 31 and the back side 51*a* of the gate member 51, as shown in FIG. 7. In the state shown in FIG. 7, a press-bonding force from the cuttings is present between outside surfaces of the solid product W and the end face of the tip 39, the inner periphery of the first cylindrical body 31 and the back side 51*a* of the gate member 51. Therefore, if, in this state, the hydraulic cylinders 53 are operated to move up the gate member 51, a frictional force between the back side 51*a* of the gate member 51 and the solid product W makes it difficult to raise the gate member 51.

Figure 9:
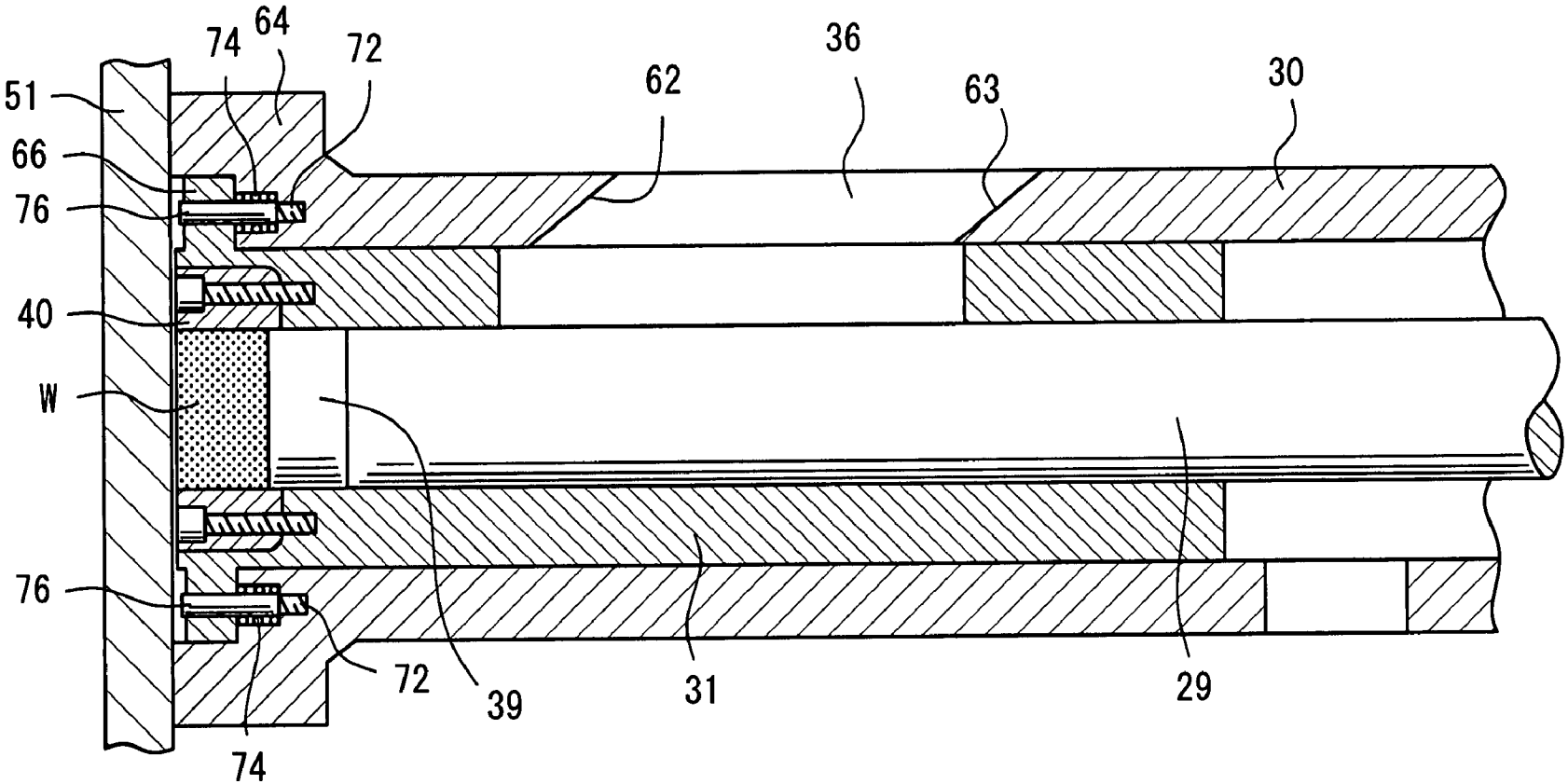
FIG. 9 is a sectional view of the essential part for explaining the operations of the compactor.

According to the embodiment of the invention, therefore, the cylinder rod 29 is moved some distance in the opposite direction (toward the upstream side). It is noted here that the small gap 75 is defined between the upstream end face of the flange 66 of the first cylindrical body 31 and the opposite end face of the inside diameter expansion of the casing 30, while a great press-bonding force is present between the solid product W, and the inner periphery of the first cylindrical body 31 and the end face of the tip 39. Accordingly, as shown in FIG. 9, the rearward movement of the cylinder rod 29 causes the solid product W and the first cylindrical body 31 to move rearwardly a little. That is, the first cylindrical body 31 is moved upstream relative to the casing 30. By rearwardly moving the solid product W together with the first cylindrical body 31 in this manner, the frictional force between the back side 51*a* of the gate member 51 and the solid product W is substantially decreased. Hence, the gate member 51 may be readily pulled up by operating the hydraulic cylinders 53.

After the gate member 51 is pulled up, the cylinder rod 29 is moved downstream again, thereby to discharge the solid product W from a downstream open end of the first cylindrical body 31. The falling solid product W may be received by, for example, a receiving member, which may be provided in the vicinity of the aforesaid open end. Subsequently, the cylinder rod 29 is returned to the rearward position while the gate member 51 is lowered, whereby a series of steps for forming the solid product W from the cuttings and discharging the solid product are completed.

Figure 10:
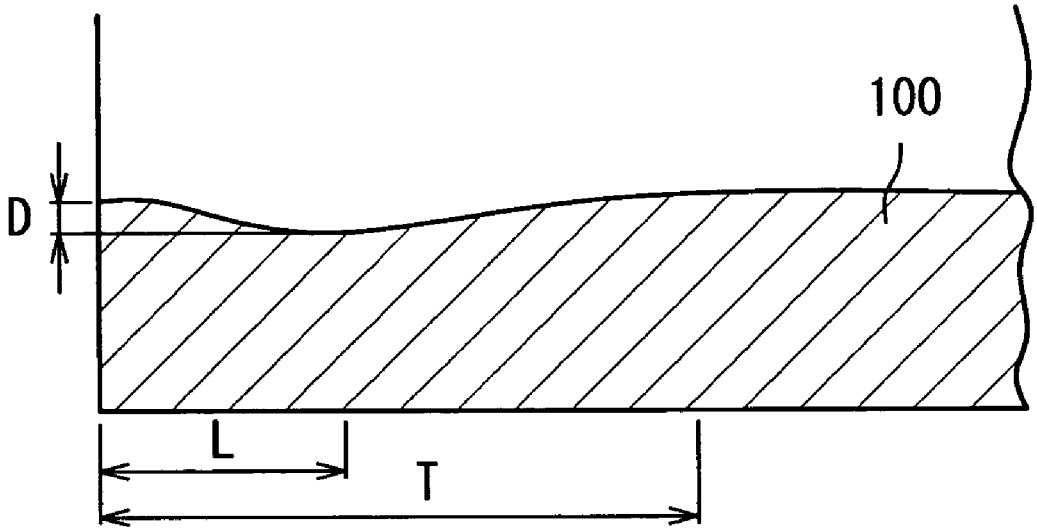
FIG. 10 is a diagram explaining wear on a conventional cylindrical body.

FIG. 10 is a diagram showing an axial cross section of a downstream portion of a cylinder body 100 defining a compaction chamber of a conventional compactor having been used for about one month. As seen in the figure, an inner periphery of the cylinder body 100 sustains wear over a range between a downstream open end (discharge port) of the cylinder body 100 and a point of about T×3/5 away from the open end, based an axial length (thickness) T of the solid product (e.g., T≈50 mm). Particularly, the wear of the cylinder body 100 peaks at a point T×3/10 away from the discharge port, at the point where the depth of wear reaches 2 to 3 mm. According to the embodiment of the invention, therefore, the second cylindrical body 40 is provided on the downstream side of the first cylindrical body. The second cylindrical body 40 is fixed to place by means of the bolts 45. When the inner periphery of the second cylindrical body 40 is worn following an extended period of use, the bolts 45 may be removed for the removal of the second cylindrical body 40 and a new second cylindrical body 40 may be fixed to place.

An adequate axial length of the second cylindrical body 40 is not less than about 4/5 times the thickness T (T×4/5) of the solid product W to be formed. The thickness requirement is based on the findings of the inventors that the wear peaks at the point about T×3/10 away from the discharge port and that little wear is observed at the point T×3/5 away from the discharge port. In the embodiment of the invention, the solid product W having the thickness (axial length) of about 50 mm is formed, for instance, and hence, the second cylindrical body 40 having the outside diameter of 125 mm and the axial length of 50 mm and formed of the heat-treated dies steel may be used in combination with the first cylindrical body having the inside diameter of 65 mm.

According to the embodiment of the invention, the dies steel having a greater hardness than a common carbon steel subjected to the heat treatment, such as a carbon steel for machine structural use, is employed as the material for the second cylindrical body 40. However, as described above, the second cylindrical body 40 is far more smaller in size than the other components such as the first cylindrical body 31 and requires much less use of the expensive steel, so that the cost for the second cylindrical body is much less than the costs for the other components. As a result, the embodiment requires much less product costs as compared to the case where the whole body of the conventional cylinder body 100 suffering wear is replaced by a new one.

According to the embodiment of the invention, the second cylindrical body 40 is disposed at place where severe wear results from quite a great frictional force between the solid product W and the inner periphery of the first cylindrical body 31 and quite a great pressing force from the solid product W. Therefore, the compactor 10 can be constantly maintained in good operational conditions simply by replacing the second cylindrical body 40 at regular time intervals. Furthermore, the replacement of the second cylindrical body 40 can be done via the gate space defined by the pair of guide members 52 and the gate member 51. This negates the need for disassembling the gate mechanism 50, leading to an easier and faster replacement operation. Time required for one service worker to open the gate member 51 and to replace the second cylindrical body 40 alone is on the order of 5 to 10 minutes. The replacement time is notably reduced as compared with that for the conventional cylinder body 100.

Although the embodiment of the invention uses the heat-treated dies steel or sintered hard alloy for forming the second cylindrical body 40, the material is not limited to these. For instance, a bearing steel such as SUJ-2, or a steel material such as HDC 60 may be used provided that the second cylindrical body is replaced at relatively short time intervals. The use of such a material contributes to the further reduction of the material costs. The aforementioned embodiment of the invention defines the axial length of the second cylindrical body 40 to be substantially equal to the thickness of the solid product W but the axial length is not limited to this. In addition, at least the inner periphery of the second cylindrical body 40 only need to have a greater hardness than the inner periphery of the first cylindrical body 31.

Figure 11:
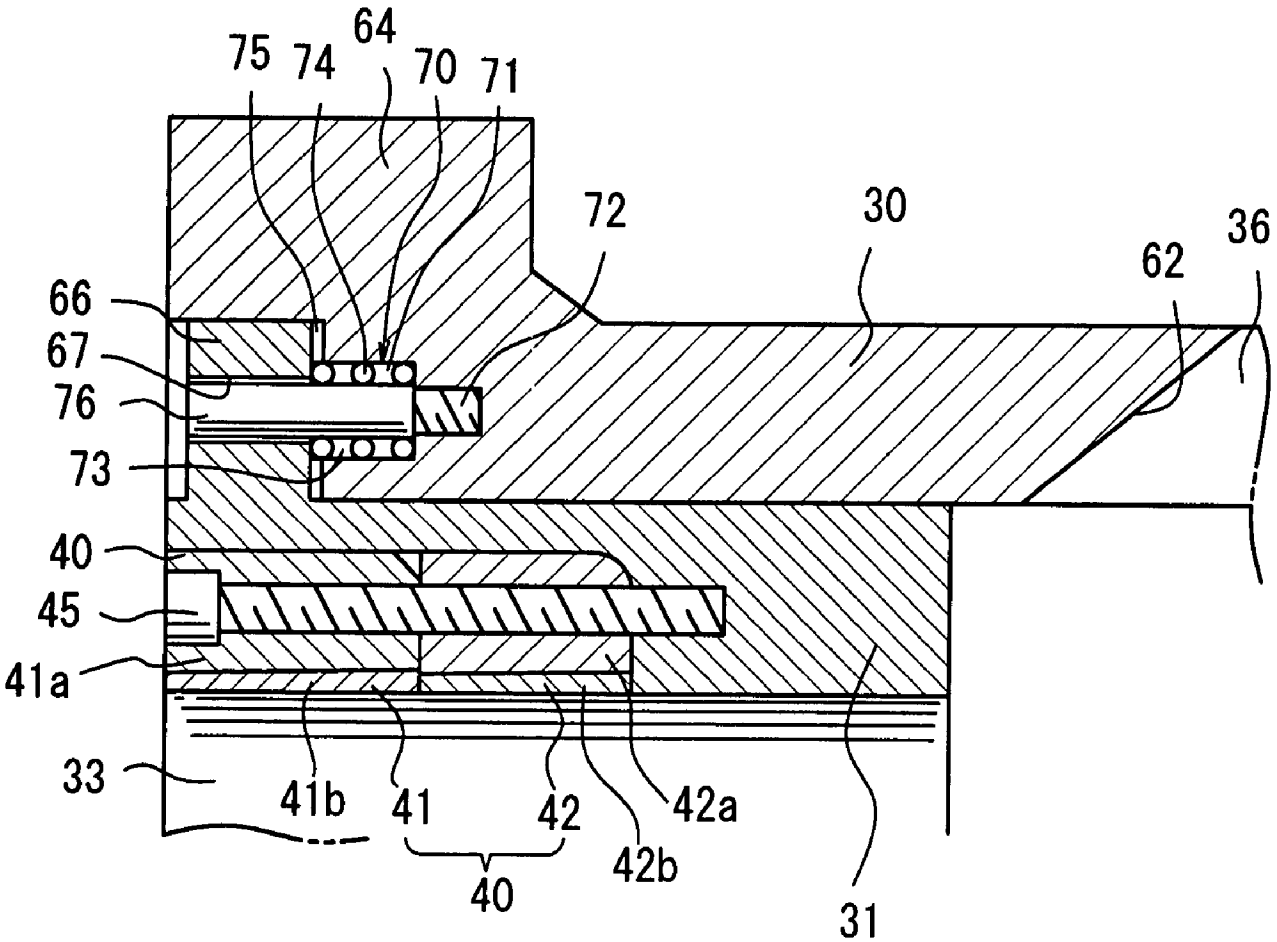
FIG. 11 is an enlarged sectional view showing an essential part of another embodiment of the invention.

FIG. 11 is a sectional view showing an essential part of another embodiment of the invention. In this embodiment, the second cylindrical body 40 includes two cylinder members 41, 42. The cylinder members 41, 42 are axially arranged in end-to-end relation. These cylinder members 41, 42 have the same outside and inside diameters but different axial lengths. Similarly to the above embodiment, the downstream cylinder member 41 has substantially the same axial length as the axial length T of the solid product W. The axial length of the upstream cylinder member 42 is, for example, about ⅗ the axial length of the downstream cylinder member 41.

The cylinder members 41, 42 include an outside cylinder 41*a*, 42*a* and an inside cylinder 41*b*, 42*b* fitted in the outside cylinder, respectively. The outside cylinder 41*a*, 42*a* is formed of a dies steel hardened to HRC 58 to 60 by heat treatment, for example, whereas the inside cylinder 41*b*, 42*b* is formed of a sintered hard alloy having a greater hardness than the outside cylinder 41*a*, 42*a*. The use of the sintered hard alloy for forming only the inside cylinders 41*b*, 42*b* leads to lower costs than the case where the whole bodies of the cylinder members 41, 42 are formed of the sintered hard alloy.

The inside cylinders 41*b*, 42*b* are shrink fitted in the respective inner peripheries of the outside cylinders 41*a*, 42*a*. A fitting surface E between the inside cylinder 41*b*, 42*b* and the outside cylinder 41*a*, 42*a* is defined by a tapered surface having the radial dimension thereof progressively decreased toward the downstream side. This permits the inside cylinders 41*b*, 42*b* to be easily and positively shrink fitted in the outside cylinders 41*a*, 42*a* for unification free from fracture.

Figure 12:
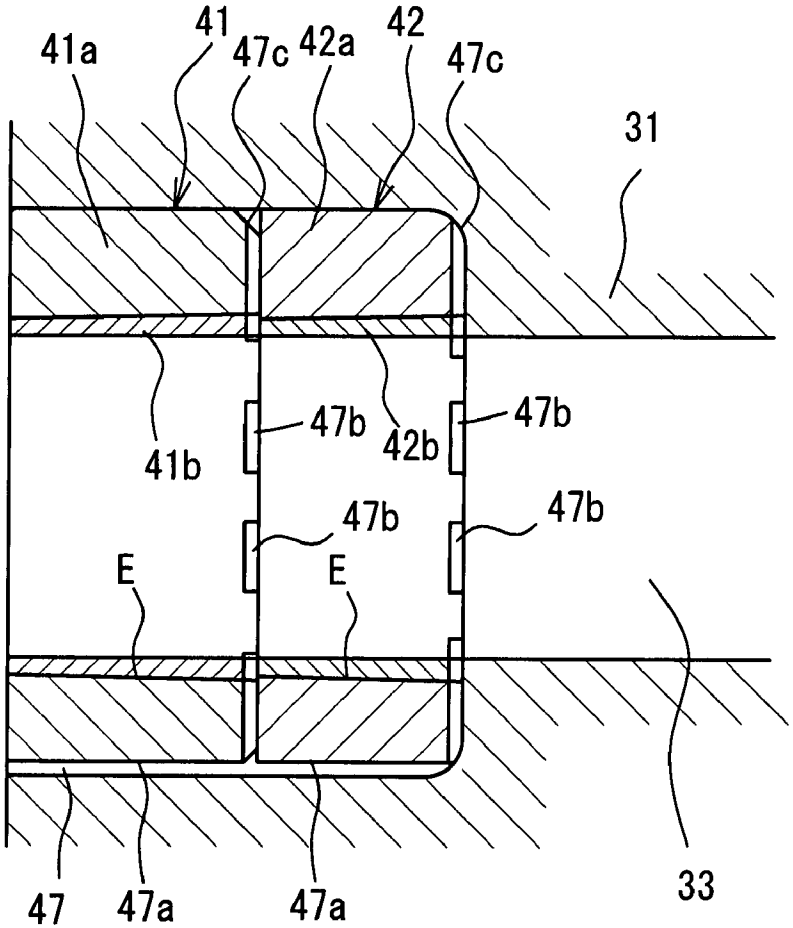
FIG. 12 is a front view showing a pair of cylinder members constituting a second cylindrical body.
Figure 13:
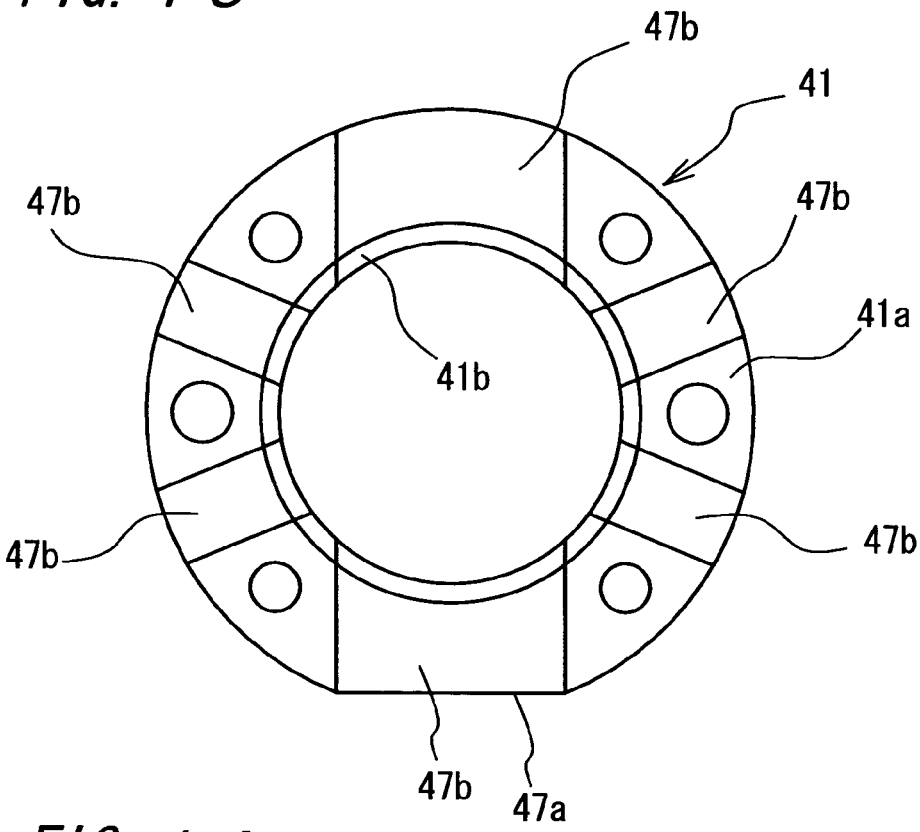
FIG. 13 is a side view of a downstream-side cylinder member as seen from the right side thereof.
Figure 14:
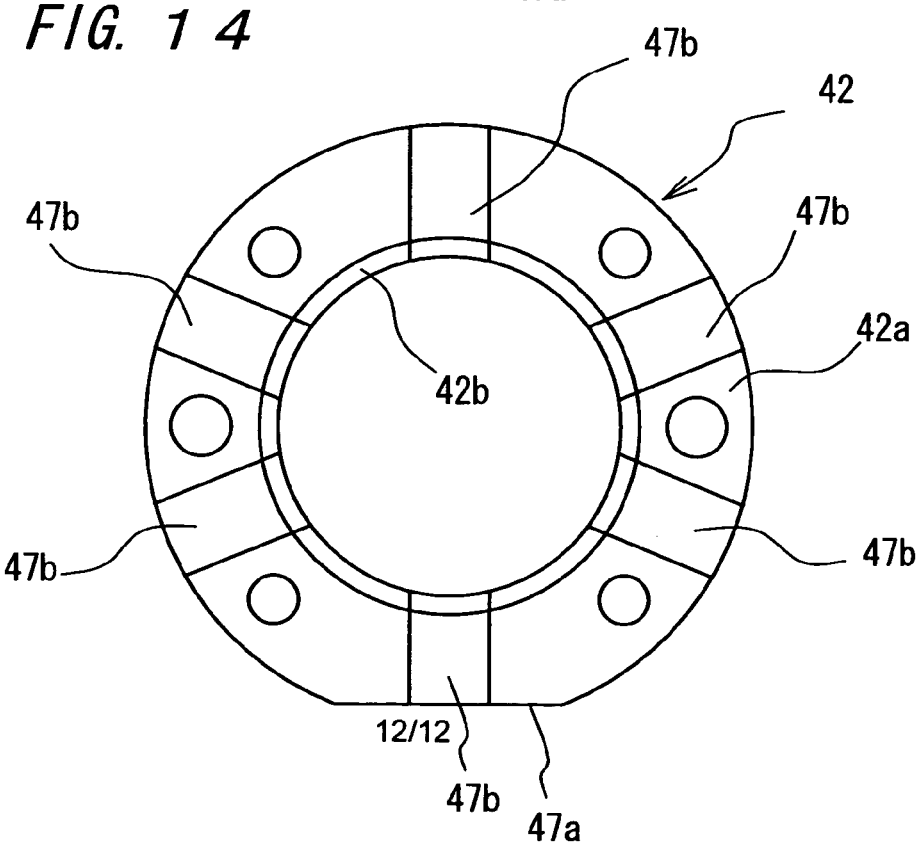
FIG. 14 is a side view of a upstream-side cylinder member as seen from the right side thereof.

The cylinder members 41, 42 are each provided with a discharge passage 47 through which liquids, such as water, oil and the like, contained in the cuttings are discharged out of the compaction chamber 33. The discharge passage 47 includes a flat face 47*a* formed at an outer peripheral bottom of each cylinder member 41, 42; a plurality of shallow grooves 47*b* radially arranged on an upstream side face of each cylinder member 41, 42; and a great chamfer 47*c* formed at an intersection between the upstream end face and the outer periphery of each cylinder member 41, 42 (see FIGS. 12 and 13). A downstream side of the discharge passage 47 is communicated with the notch 51*b* formed at the lower portion of the gate member 51 (see FIG. 5). The liquids from the cuttings being compacted can be collected in the notch 51*b* of the gate member 51 so as to be discharged from the compaction chamber 33. This results in a solid product W containing less residual liquids.

According to the embodiment shown in FIG. 1, the extended service life of the second cylindrical body 40 means the relatively shorter service life of the first cylindrical body 31 due to wear. The wear on the inner periphery of the first cylindrical body 31 is particularly heavy at a portion close to the second cylindrical body 40. According to the embodiment shown in FIG. 11, the cylinder member 42 having a superior wear resistance is disposed at such a place suffering the heavywear. Hence, the first cylindrical body 31 is prevented from suffering the relatively shorter service life due to wear. As a result, the compaction chamber 33 can be used in good conditions over a further extended period of time. The downstream cylinder member 41 is more heavily worn than the upstream cylinder member 42, resulting in the shorter service life than the upstream cylinder member 42. However, the second cylindrical body 40 consists of the two cylinder members 41, 42 such that only the downstream cylinder member 41 having the shorter service life can be replaced. This leads to a lower running cost than the case where the second cylindrical body 40 is composed of a single long cylinder body.

It is noted that the invention is not limited to the aforementioned embodiments and various changes and modifications may be made thereto within the scope of the invention set forth in the appended claims thereof. It goes without saying that such changes and modifications are included in the scope of the invention. According to the embodiment of the invention, the compactor including the casing 30 and the first cylindrical body 31 relatively movable to the casing 30 is arranged such that the second cylindrical body 40 having a predetermined axial length is disposed near the downstream end of the first cylindrical body 31. However, the invention is applicable to compactors having other arrangements. Specifically, the invention may also be applied to compactors wherein the casing and the first cylindrical body are fixed to each other; or wherein the casing and the first cylindrical body are formed in one piece.

Although the second cylindrical body 40 consists of the two cylinder members 41, 42 according to the embodiment shown in FIG. 11, the second cylindrical body 40 may include three or more cylinder members.

What is claimed is:

1. A compactor used for compacting sludge containing abrasive grains and small-particle metallic residue, comprising:

a first cylindrical body including an expansion formed at an inner periphery of a first end portion thereof, said expansion having a greater inner circumferential dimension than that of a second end portion thereof, and for accommodating in said first cylindrical body a material to be compacted;

a second cylindrical body replaceably mounted in the expansion of the first cylindrical body to form a compaction chamber jointly with the first cylindrical body, and having an inner peripheral surface flush with that of the first cylindrical body;

a pressing mechanism for pressing material to be compacted toward said first end of the compaction chamber; and a gate mechanism for opening or closing said first end of the compaction chamber;

wherein an axial length of the second cylindrical body is substantially not less than ⅗ times the axial length of a compact obtained by compacting material to be compacted, and wherein the abrasive grains have a hardness of not less than 1950 Knoop Hardness.

2. A compactor as claimed in claim 1, wherein at least an inner periphery of the second cylindrical body has a higher hardness than that of the inner periphery of the first cylindrical body.

3. A compactor as claimed in claim 1, wherein at least the inner periphery of the second cylindrical body is formed of a sintered hard alloy.

4. A compactor as claimed in claim 1, wherein the second cylindrical body comprises an outside cylinder hardened by quenching, and an inside cylinder formed of a sintered hard alloy and fitted in an inner periphery of the outside cylinder.

5. A compactor as claimed in claim 4, wherein a fitting surface between the inside cylinder and the outside cylinder is a tapered surface having the radial dimension thereof progressively decreased toward the one end of the second cylindrical body.

6. A compactor as claimed in claim 1, wherein the second cylindrical body is formed with a discharge passage serving to guide liquid, discharged from the material to be compacted, out of the compaction chamber.

7. A compactor as claimed in claim 1, wherein the second cylindrical body comprises a plurality of cylinder members arranged in end-to-end relation.

8. A compactor as claimed in claim 1, wherein the gate mechanism defines a gate space of a sufficient size for permitting the second cylindrical body to be mounted to or removed from the first cylindrical body in a state where the one end of the compaction chamber is opened.

* * * * *